US008530767B2

(12) United States Patent
Kuroda

(10) Patent No.: US 8,530,767 B2
(45) Date of Patent: Sep. 10, 2013

(54) MULTI-DIRECTIONAL SWITCH DEVICE

(75) Inventor: Shingo Kuroda, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 121 days.

(21) Appl. No.: 13/331,873

(22) Filed: Dec. 20, 2011

(65) Prior Publication Data

US 2012/0160651 A1 Jun. 28, 2012

(30) Foreign Application Priority Data

Dec. 22, 2010 (JP) ..... 2010-285956

(51) Int. Cl.
*H01H 9/26* (2006.01)
*H01H 13/72* (2006.01)

(52) U.S. Cl.
USPC ..... 200/5 A; 200/6 A; 200/17 R

(58) Field of Classification Search
USPC ..... 200/4, 5 A, 5 R, 6 A, 6 R, 17 R, 200/18, 329
See application file for complete search history.

(56) References Cited

U.S. PATENT DOCUMENTS

| | | | | |
|---|---|---|---|---|
| 6,069,327 | A * | 5/2000 | Ushimaru | 200/5 R |
| 6,515,242 | B2 | 2/2003 | Takatsuki | |
| 6,541,716 | B2 * | 4/2003 | Gotoh | 200/6 A |
| 7,078,632 | B2 * | 7/2006 | Komatsu | 200/5 R |
| 7,884,291 | B2 * | 2/2011 | Terao | 200/6 A |

FOREIGN PATENT DOCUMENTS

JP 2005-044724 2/2005

* cited by examiner

*Primary Examiner* — Kyung Lee
(74) *Attorney, Agent, or Firm* — Brinks Hofer Gilson & Lione

(57) ABSTRACT

In a multi-directional switch device including: an operation body which moves to be inclined in multiple directions; four actuators which are operated to be pressed by an inclination operation of the operation body so as to be moved; and three switch elements which perform switching operations by the movements of the actuators, the first actuator causes the first switch element to perform the switching operation, the second actuator causes the second switch element to perform the switching operation, the third actuator causes the third switch element to perform the switching operation, and the fourth actuator causes the first switch element to perform the switching operation, such that the plurality of actuators are disposed at positions where any of the three switch elements performs the switching operation even through the operation body is operated to be inclined in any direction.

3 Claims, 11 Drawing Sheets

MULTI-DIRECTIONAL SWITCH DEVICE

CLAIM OF PRIORITY

This application claims benefit of Japanese Patent Application No. 2010-285956 filed on Dec. 22, 2010, which is hereby incorporated by reference in its entirety.

BACKGROUND

1. Field of the Disclosure

The present disclosure relates to a multi-directional switch device which performs a switching operation in response to a pressing operation in multiple directions of an operation body.

2. Description of the Related Art

In general, a multi-directional switch device is widely used in remote controllers of various electronic devices such as televisions and videos, mobile phones, door mirrors for a vehicle, and the like. The multi-directional switch device is appropriately used particularly for operating the door mirrors for a vehicle.

A four-way switch used for operating a door mirror of a vehicle has been disclosed in JP-A-2001-229784. Here, a switch device 800 having three switch elements 806 as shown in FIG. 8 is proposed. The switch device 800 shown in FIG. 8 includes an operation member 804 locked to a case 801 to be oscillated in four directions, the three groups of switch elements 806 respectively disposed at three points of the peripheral edge of the operation member 804, and three driving members 802 which receive oscillation driving in four directions of the operation member 804 and causes the switch elements 806 to perform a switching operation. Between the operation member 804 and the driving member 802, a rubber spring 803 which has four spring parts 813 in order to obtain a clicking sensation is provided. Each of the three groups of switch elements 806 is configured by a movable contact point 807 provided in a slide member 805, and a fixed contact point 808 provided in a printed wiring board 809.

In the switching device 800, for example, when the operation member 804 is oscillated in the N direction shown in FIG. 8, a spring part 813*a* of the rubber spring 803 is buckled, a driving member 802*a* is driven, a slide member 805*a* is slid by the driving of the driving member 802*a*, and a switch element 806*a* performs a switching operation. Similarly, the switch element 806*a* and a switch element 806*b* perform switching operations during oscillation in the W direction, the switch element 806*b* and a switch element 806*c* perform switching operations during oscillation in the S direction, and the switch element 806*c* performs a switching operation during oscillation in the E direction, thereby enabling a switching operation in four directions.

In addition another multi-directional switch device is proposed in JP-A-2005-44724. Here, a mirror switch device 900 having four switch parts 921 as shown in FIG. 11 is proposed. The mirror switch devices 900 shown in FIG. 11 include a pusher 919 which has a substantially rectangular shape and in which each of four side portions is pushed, the four switch parts 921 arranged at four points of the corner sites of the rectangular side portions, an operation knob 912 which operates the pusher 919 to be pushed, and a switch case 911 provided to operate the operation knob 912 to be pushed. The four switch parts 921 include four movable contact point plates 922 provided in a presser unit 918 and four fixed contact points 923 provided in a printed wiring board 913.

In the mirror switch device 900, when a side portion of the pusher 919 is pushed by the pushing operation of the operation knob 912, the two switch parts 921 corresponding to this side portion perform switching operations. Similarly, when the three other side portions are pushed, the corresponding two switch parts 921 perform switching operations, thereby enabling the switching operations in four directions which are the directions of the four side portions.

In general, when the four-way switch device for operating the door mirror of a vehicle is operated in four directions (the N direction, the W direction, the S direction, and the E direction) by switching operations, the door mirror is generally moved in four directions including up, down, left, and right. In addition, for example, when the switch device is operated in a left inclined direction, in general, the door mirror is not operated, or is moved in the left direction or the up direction. In addition, even though an operator operates the switch device in an inclined direction and the door mirror does not operate, the operator may change an operation position to operate the mirror without discomfort.

However, there is a need for a switching operation in any direction for any purpose or demand from the side of a user.

In a configuration as in the example 1 according to the related art in JP-A-2001-229784, as shown in FIG. 9, when the operation member 804 is operated to be oscillated in another direction than the four directions (the N direction, the W direction, the S direction, and the E direction), in the NW, SW, and SE directions, any of the driving members 802 (the driving members 802*a*, 802*b*, and 802*c*) is driven, and any of the switch elements 806 performs a switching operation. However, when the operation member 804 is operated to be oscillated in the NE direction, since there are only three switch elements 806, there is a problem in that not all the switch elements 806 perform the switching operations and a non-operation region where the switching operation is not performed is generated.

In addition, in the example 2 according to the related art in JP-A-2005-44724, although a switching operation can be performed in other directions than the four directions (the N, W, S, and E directions), the switch parts 921 are arranged at four points of the corner sites of the rectangular side portions. Therefore, when the pusher 919 is operated to be pushed in any direction, any of the four switch parts 921 performs a switching operation. However, in the configuration as in the example 2, although the non-operation region disappears, there is a problem in that components for four circuits are needed and thus the number of components is increased. In addition, since a fourth switch part is provided at a fourth point, components or circuits that may be arranged at the point have to be arranged at another point, so that there is a problem in that the advantage in reducing the size which was achieved by the example 1 according to the related art is compromised.

SUMMARY

A multi-directional switch device includes: an operation body which moves to be inclined in multiple directions; a housing which holds the operation body; a plurality of actuators which are operated to be pressed by an inclination operation of the operation body so as to be moved; and a plurality of switch elements which perform switching operations by the movements of the actuators, wherein the plurality of actuators includes a first actuator, a second actuator, a third actuator, and a fourth actuator, the plurality of switch elements includes a first switch element, a second switch element, and a third switch element, in a plan view of the operation body, a first inclination direction passing through the vicinity of an inclination center of the operation body, a second inclination direction intersecting the first inclination direction through the vicinity of the inclination center, a third inclination direction which is the opposite direction to the first inclination direction, and a fourth inclination direction which is the opposite direction to the second inclination direction are provided, in the operation body, a first position in the first inclination direction, a second position in the second inclination direction, a third position in the third inclination direction, and a fourth position in the fourth inclination direction are provided, the first actuator is disposed to oppose the first position and causes the first switching element to perform the switching operation, the second actuator is disposed to oppose the second position and causes the second switching element to perform the switching operation, and the third actuator is disposed to oppose the third position and causes the third switching element to perform the switching operation, and the fourth actuator causes the first switching element to perform the switching operation, such that the plurality of actuators are disposed at the positions where any of the plurality of switch elements perform the switching operation even though the operation body is operated to be inclined in any direction.

Accordingly, since the multi-directional switch device of the invention is provided with the new fourth actuator in addition to the actuators corresponding to the switch elements, a non-operation region where a switching operation is not performed when the operation body is operated to be inclined can be eliminated, and moreover, there is no need to add a switch element, resulting in a reduction in size.

In addition, in the multi-directional switch device of the invention, the first actuator and the fourth actuator may be integrated with each other.

Accordingly, since the two actuators are integrated with each other, compared to a case where an additional mechanism is provided for each of the actuators, a greater reduction in size can be achieved, and assembly can be easily performed.

In addition, the multi-directional switch device of the invention may further include: elastic portions corresponding to the respective actuators on the peripheral edges of the operation body in the housing; and an elastic member having the elastic portions, the elastic portion is buckled by the inclination operation of the operation body, such that the elastic portion presses the actuator.

Accordingly, since the elastic member having the elastic portions corresponding to the respective actuators is provided between the operation body and the actuators, the elastic portion is buckled, and when the operation body is operated to be inclined, the operator can obtain a clicking sensation.

Since the multi-directional switch device of the invention is provided with the new fourth actuator in addition to the actuators corresponding to the switch elements, the non-operation region where a switching operation is not performed when the operation body is operated to be inclined can be eliminated, and moreover, there is no need to add a switch element, resulting in a reduction in size.

Therefore, a multi-directional switch device in which there is no non-operation region where a switching operation is not performed with regard to a pressing operation in multiple directions of the operation body and which can be reduced in size can be provided.

BRIEF DESCRIPTION OF THE DRAWINGS

FIGS. 4A to 4D are diagrams illustrating an operation body of the multi-directional switch device of the first embodiment of the invention, in which FIG. 4A is a top view, FIG. 4B is a bottom view, and FIGS. 4C and 4D are side views;

FIGS. 11A and 11B are diagrams illustrating a mirror switch device of an example 2 according to the related art, in which FIG. 11A is a longitudinal cross-sectional view, and FIG. 11B is a plan view of a printed wiring board showing an arrangement of switch portions.

DESCRIPTION OF THE EXEMPLARY EMBODIMENTS

Hereinafter, exemplary embodiments of the invention will be described in detail with reference to the accompanying drawings.

First Embodiment

Figure 1:
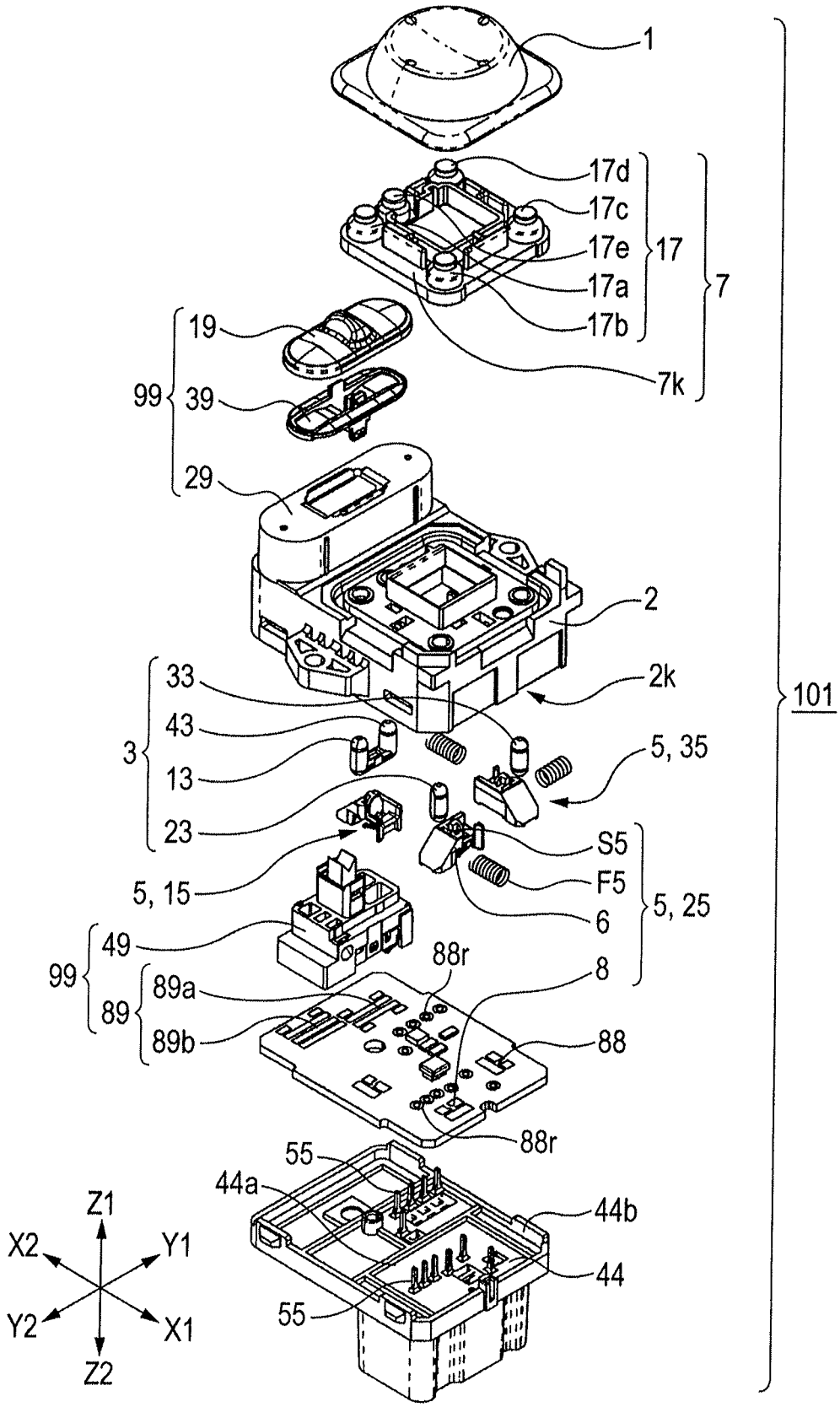
FIG. 1 is an exploded perspective view of a multi-directional switch device illustrating the multi-directional switch device of a first embodiment of the invention.
Figure 2A:
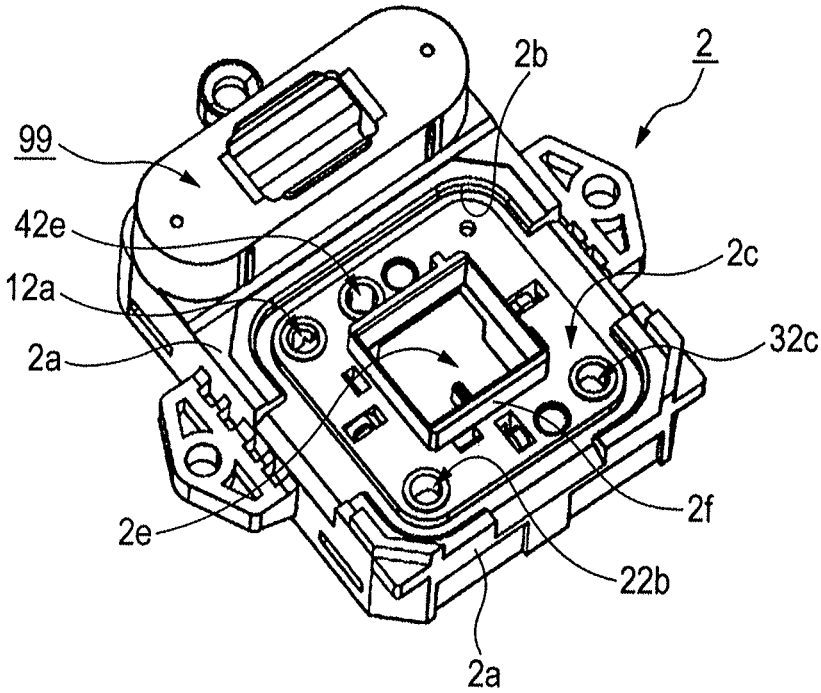
FIGS. 2A and 2B are perspective views illustrating a housing of the multi-directional switch device of the first embodiment of the invention.
Figure 2B:
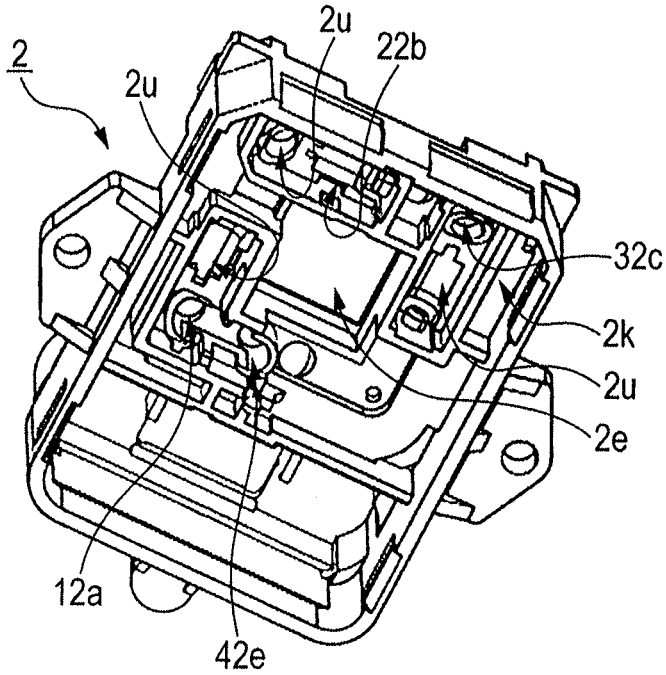
Figure 3A:
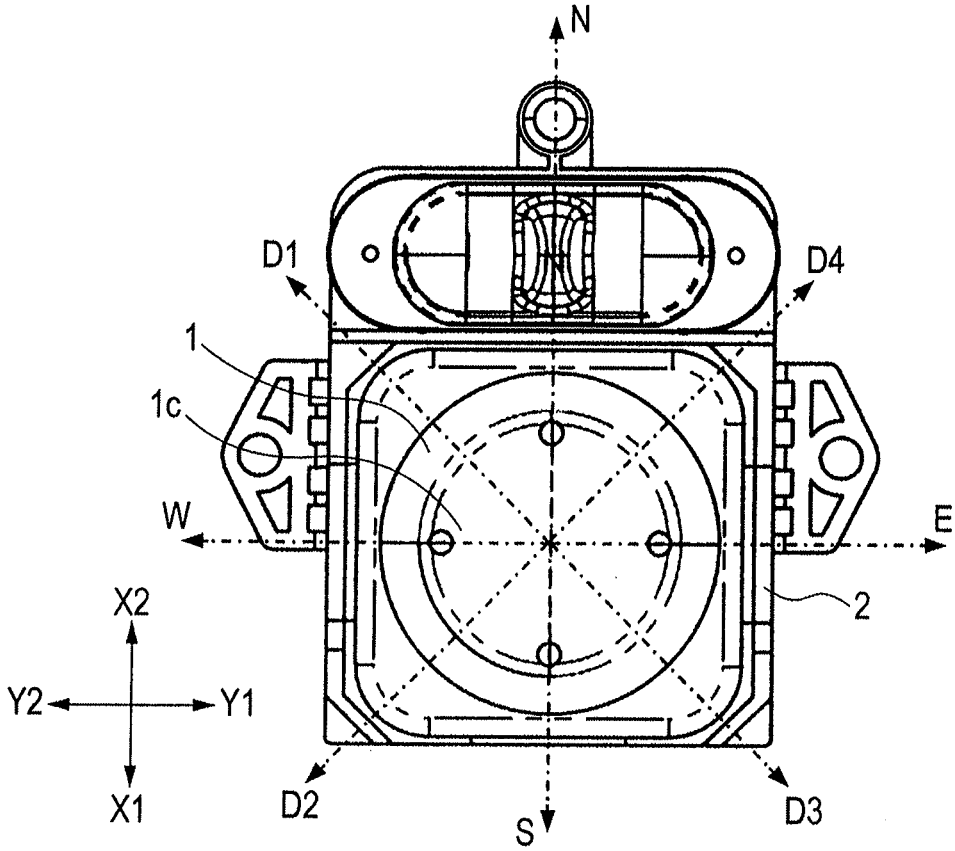
FIGS. 3A and 3B are top views of the multi-directional switch device illustrating the multi-directional switch device of the first embodiment of the invention.
Figure 3B:
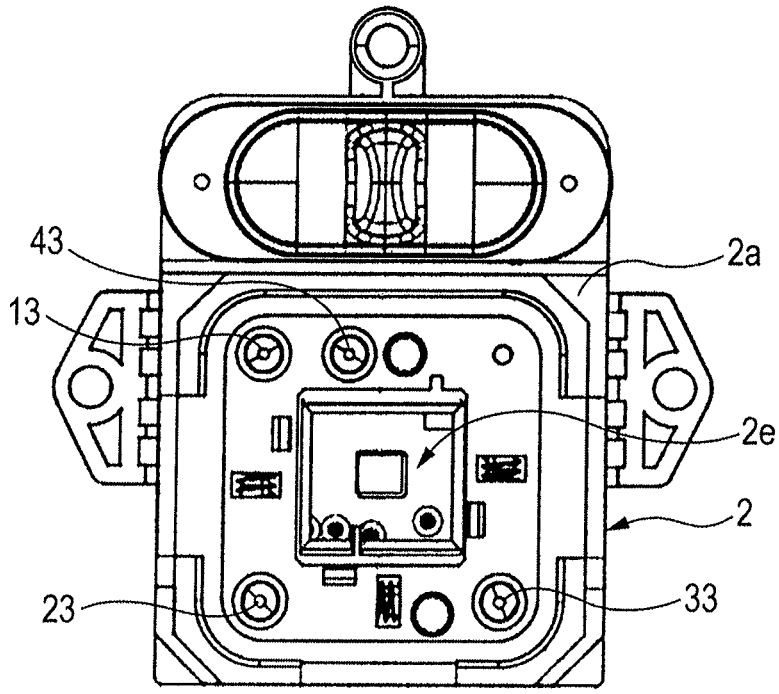

FIG. 1 is an exploded perspective view of a multi-directional switch device 101 illustrating the multi-directional switch device 101 of a first embodiment of the invention. FIGS. 2A and 2B are perspective views illustrating a housing 2 of the multi-directional switch device 101 of the first embodiment of the invention, FIG. 2A is a diagram viewed from an operation body 1 side, and FIG. 2B is a diagram viewed from an opening portion 2*k* side. FIGS. 3A and 3B are top views of the multi-directional switch device 101 illustrating the multi-directional switch device 101 of the first embodiment of the invention, FIG. 3A is a diagram viewed from the operation body 1 side, and FIG. 3B is a diagram in which the operation body 1 and an elastic member 7 of FIG. 3A are omitted for convenience of description.

Figure 4A:
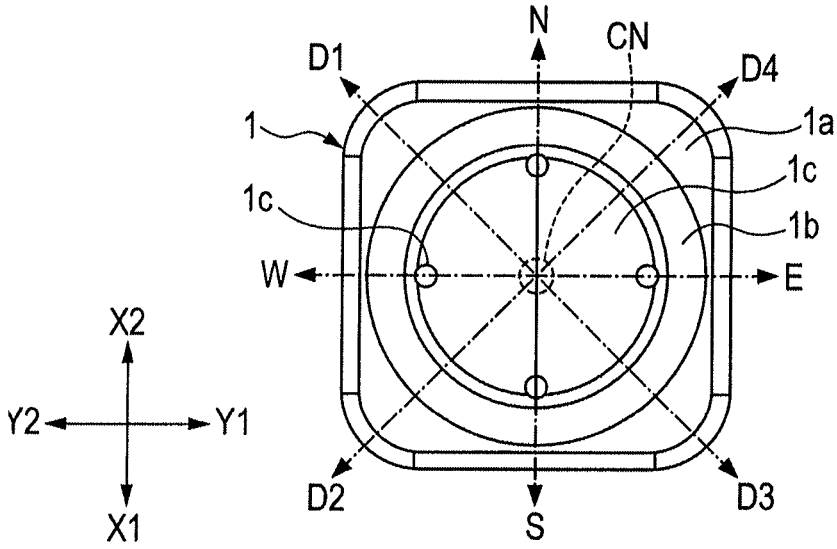
Figure 4B:
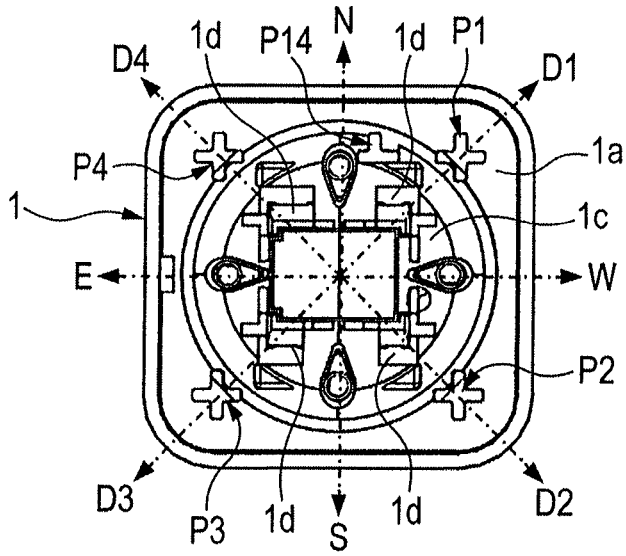
Figure 4C:
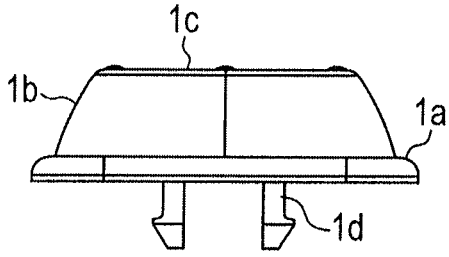
Figure 4D:
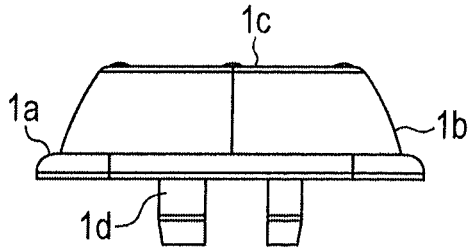
Figure 5:
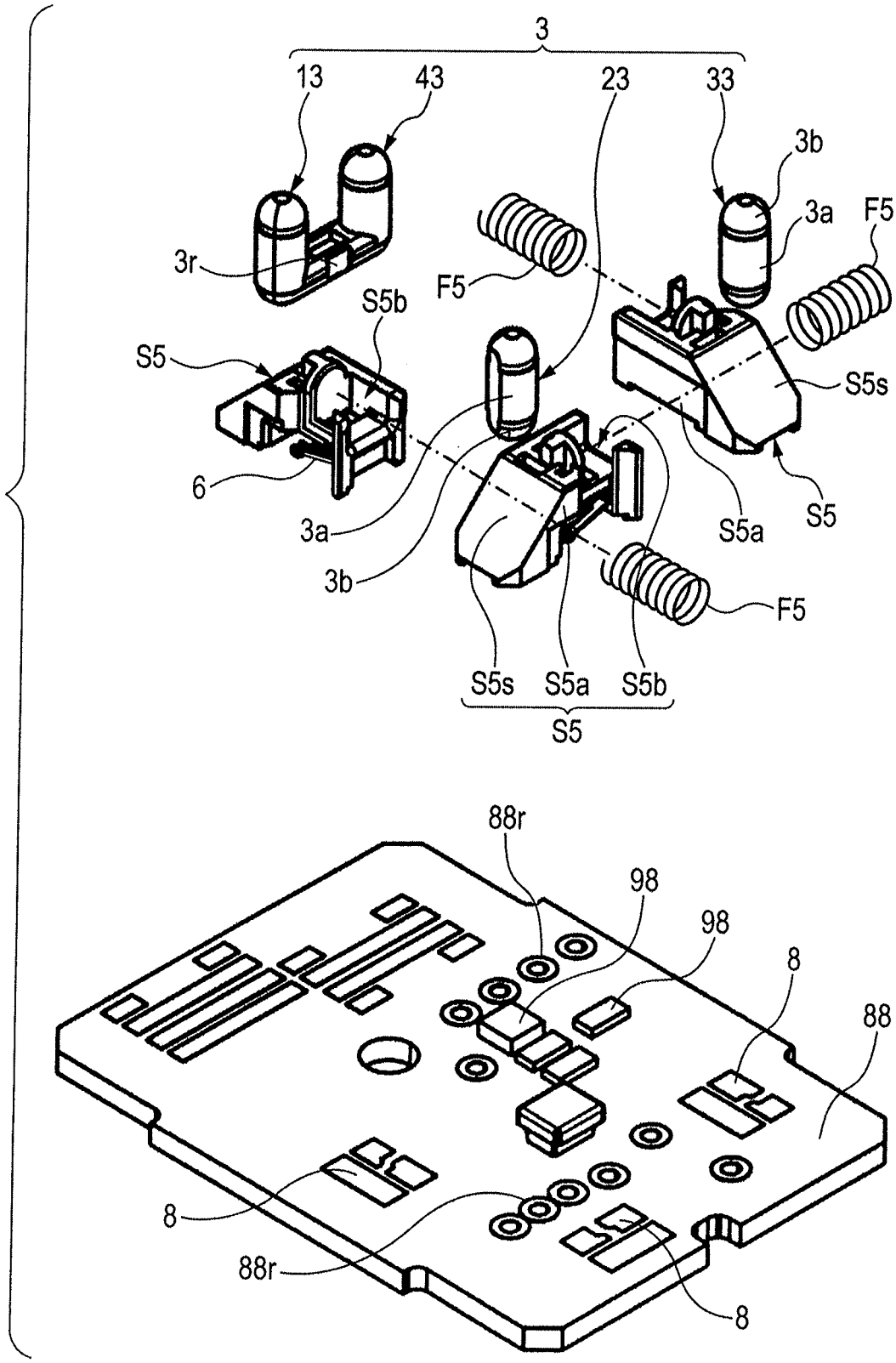
FIG. 5 is a diagram illustrating the multi-directional switch device of the first embodiment of the invention and is an exploded perspective view of actuators, switch elements, and a printed wiring board.

FIGS. 4A to 4D are diagrams illustrating the operation body 1 of the multi-directional switch device 101 of the first embodiment of the invention, FIG. 4A is a top view, FIG. 4B is a bottom view, FIG. 4C is a side view viewed from an X1 side, and FIG. 4D is a side view viewed from an Y2 side. FIG. 5 is a diagram illustrating the multi-directional switch device 101 of the first embodiment of the invention and is an exploded perspective view of actuators 3, switch elements 5, and a printed wiring board 88.

The multi-directional switch device 101 mainly includes, as shown in FIG. 1, the operation body 1 which is moved to be inclined in multiple directions, the housing 2 which holds the operation body 1, a plurality of actuators 3 which are moved by being pressed by the inclination operation of the operation body 1, and a plurality of switch elements 5 which perform switching operations by the movement of the actuator 3. Besides, the multi-directional switch device 101 is configured to have the elastic member 7 provided between the operation body 1 and the actuators 3, the printed wiring board 88, a cover 44 which is disposed to cover the opening portion 2*k* of the housing 2, and a changeover switch 99 for changing over an object to be subjected to a switching operation.

The housing 2 is made of, for example, a synthetic resin material, is formed by an injection molding process, is produced to be adjacent to the changeover switch 99 described later as shown in FIGS. 2A and 2B, has a substantially box shape, and has a substantially rectangular base body 2*a* and a substantially rectangular recessed portion 2*c* provided in the base body 2*a*. In addition, the recessed portion 2*c* has circular through-holes 12*a*, 22*b*, and 32*c* provided in the vicinity of three angular portions from four angular portions of the bottom surface of the recessed portion 2*c*, a circular through-hole 42*e* provided in the vicinity of the through-hole 12*a*, a rectangular angular hole 2*e* provided at the center portion of the recessed portion 2*c*, and a protruding wall 2*f* vertically extending toward the operation body 1 side from the periphery of the angular hole 2*e*. In addition, the angular hole 2*e* has a function of holding the operation body 1 described later which is moved to be inclined in multiple directions. The rear side of the recessed portion 2*c* of the housing 2 is the opening portion 2*k*.

The operation body 1 is made of, for example, a synthetic resin material, is formed by an injection molding process, and has, as shown in FIG. 3A and FIGS. 4A to 4D, a substantially rectangular base body 1*a*, a side wall 1*b* which extends upward from the peripheral edge portion of the base body 1*a* and surrounds the peripheral edge portion, a circular upper wall 1*c* connected to the side wall 1*b*, and four engagement portions 1*d* protruding inward from the rear side of the upper wall 1*c*. In addition, the four engagement portions 1*d* of the operation body 1 are engaged with the peripheral edge wall of the angular hole 2*e* of the recessed portion 2*c* of the housing 2 by an appropriate method such as snap-in engagement, the operation body 1 is locked to the housing 2 by the engagement of the four engagement portions 1*d*, and the operation body 1 is configured to move in the recessed portion 2*c* to be inclined in arbitrary multiple directions including the four directions (for example, the N-S direction and the E-W direction).

In addition, the operation body 1 includes, as shown in FIGS. 3A and 4A, in a plan view of the operation body 1, a first inclination direction D1 passing through the vicinity CN of the inclination center of the operation body, a second inclination direction D2 intersecting the first inclination direction D1 through the vicinity CN of the inclination center, a third inclination direction D3 which is the opposite direction to the first inclination direction D1, and a fourth inclination direction D4 which is the opposite direction to the second inclination direction D2. In addition, the operation body 1 has, as shown in FIG. 4B, on the peripheral edge of the rear side of the base body 1*a*, a first position P1 in the first inclination direction D1, a second position P2 in the second inclination direction D2, a third position P3 in the third inclination direction D3, and a fourth position P4 in the fourth inclination direction D4. At the first, second, third, and fourth positions P1, P2, P3, and P4, protruding portions which have cross shapes in cross-sections and protrude inward from the base body 1*a* are formed. As for the relationship of the four positions, the four positions are the respective vertex positions of a square shape.

In addition, the operation body 1 is disposed so as to cover almost the entire open end of the recessed portion 2*c* of the housing 2, and here, the cross-shaped protruding portions formed at the first, second, third, and fourth positions P1, P2, P3, and P4 respectively oppose and abut on the flat surfaces of the front ends of elastic portions 17*a*, 17*b*, 17*c*, and 17*d* of the elastic member 7 described later. As the elastic portions 17*a*, 17*b*, 17*c*, and 17*d* respectively abut on the cross-shaped protruding portions formed at the first, second, third, and fourth positions P1, P2, P3, and P4, the operation body 1 is maintained in an elastically urged outward of the housing 2.

The actuators 3 are made of, for example, a synthetic resin material, are formed by an injection molding process, as shown in FIG. 5, have cylindrical base portions 3*a* and substantially hemispherical driving portions 3*b* provided at both ends of the base portion 3*a*, and is constituted by four actuators including first, second, third, and fourth actuators 13, 23, 33, and 43. In addition, each of the actuators 3 are arranged, as shown in FIG. 3B, to be able to slide in the through-holes 12*a*, 22*b*, 32*c*, and 42*e* of the housing 2 shown in FIGS. 2A and 2B, and here, the actuators 3 are arranged to protrude upward from the respective through-holes.

In addition, the first actuator 13 is disposed to oppose the first position P1, and similarly, the second and third actuators 23 and 33 are disposed to respectively oppose the second and third positions P2 and P3. In addition, the fourth actuator 43 is disposed between the first and fourth positions P1 and P4 to be closer to the first position P1 side. In addition, as shown in FIG. 4B, at a position P14 opposing the fourth actuator 43 at the peripheral edge of the rear side of the base body 1*a* of the operation body 1, a protruding portion is formed which has a T-shaped cross-section and protrudes inward from the rear side of the base body 1*a*.

The switch elements 5 include, as shown in FIG. 5, three switch elements including first, second, and third switch elements 15, 25, and 35 which perform switching operations in response to the movements of the actuators 3. In addition, each of the switch elements 5 include a slide member S5 which is pressed by the actuator 3 in response to the movement of the actuator 3, a movable contact point 6 provided integrally with the slide member S5, a fixed contact point 8 disposed to come in contact with and be separated from the movable contact point 6, and a returning member F5 which elastically urges the slide member S5 to return the actuator 3 to a non-pressing operation position.

The slide member S5 has a base portion S5*a* having a substantially wedge shape, a recessed portion S5*b* provided on the upper surface of the base portion S5*a*, and an inclined portion S5*s* provided in one end portion of the base portion S5*a*. The slide member S5 is accommodated in an accommodation recessed portion 2*u* of the housing 2 shown in FIG. 2B so as to be able to slide, and in addition, to each inclined portion S5*s*, the driving portion 3*b* of the corresponding actuator 3. In addition, the actuator 3 is operated to be pressed as the operation body 1 is inclined, and as the inclined portion S5*s* is pressed in response to the downward movement of the actuator 3, the slide member S5 is moved so as to slide.

The movable contact point 6 is made of a metal material such as phosphor bronze, is formed by a press process, and has a plurality of slider pieces. The movable contact point 6 is fixed to the slide member S5, and is slid by the slide movement of the slide member S5.

The fixed contact point 8 is provided in the printed wiring board 88 and is placed at such a position that the slider of the movable contact point 6 in the slide member S5 with which the movable contact point 6 is assembled can come in contact with or be separated from the fixed contact point 8. In addition, as the slider piece of the movable contact point 6 and the fixed contact point 8 come in contact with or are separated from each other by the slide movement of the slide member S5, ON and OFF switching operations are performed.

The returning member F5 is made of a metal material and uses a coil spring which is formed into a spiral shape and has a predetermined diameter. One end portion side thereof is accommodated in the recessed portion S5*b* of the slide member S5 and the other end side abuts on the housing 2, such that the slide member S5 is elastically urged toward the one side by the returning member F5. In addition, when the inclination operation of the operation body 1 and the actuator 3 is moved upward to weaken pressing against the inclined portion Sys, the slide member S5 is slid to the its original position by the returning member F5.

The cover 44 is made of, for example, a synthetic resin material, is formed by an injection molding process, and as shown in FIG. 1, has a substantially rectangular base portion 44*a*, a side wall 44*b* extending substantially vertically from the peripheral edge portion of the base portion 44*a*, and a plurality of terminals 55 arranged integrally with the base portion 44*a* by an insert molding process. On the base portion 44*a* of the cover 44, the printed wiring board 88 is disposed so that the terminals 55 penetrate through solder lands 88*r*. Here, the solder lands 88*r* and the terminals 55 are soldered to each other so that the printed wiring board 88 and the cover 44 are integrated with each other. In addition, the cover 44 with which the printed wiring board 88 is integrated is dispose to cover the opening portion 2*k* of the housing 2, and the housing 2 and the cover 44 are engaged with each other by an appropriate method such as snap-in engagement.

Next, the operations of the multi-directional switch device 101 will be described.

First, for example, when an operator presses substantially the center portion of the left end side of the upper wall 1*c* of the operation body 1 with a finger (not shown), as shown in FIG. 3A and FIGS. 4A to 4D, the operation body 1 is inclined to the left by the pressing (the inclination direction W). In addition, when the operation body 1 is inclined to the left, the two positions on the left of the operation body 1, that is, the first and second positions P1 and P2 are lowered, and via the elastic member 7 described later, the first actuator 13 disposed to oppose the first position P1 and the second actuator 23 disposed to oppose the second position P2 are pressed downward.

By the downward slide of the first and second actuators 13 and 23, the driving portions 3*b* of the two actuators 3 (13 and 23) respectively press the inclined portions S5*s* of the two slide members S5 downward, and here, the slide members S5 are slid together with the movable contacts 6 on the fixed contact point 8 of the printed wiring board 88 against the elastically urging force of the returning member F5. The slide member S5 corresponding to the first actuator 13 is slid in the S direction shown in FIG. 3A, and the slide member S5 corresponding to the second actuator 23 is slid in the E direction shown in FIG. 3A. By the slides of the two slide members S5, the slider pieces of the movable contact points 6 respectively come in contact with the fixed contact points 8, and two so-called switch elements 5 (the first and second switch elements 15 and 25) enter the ON state.

Next, when the operator detaches their finger from the operation body 1 so as to stop pressing the operation body 1, the two slide members S5 are slid to return to the original positions by the elastically urging force of the two returning members F5. Here, the slider pieces of the movable contact points 6 become distant from the respective fixed contact points 8, and the two so-called switch elements 5 enter the OFF state. The two actuators 3 (13 and 23) are pushed up by the slides of the slide members S5, and the operation body 1 is pushed up to be returned to the original position by the self-returning force of the elastic member 7 described later. Therefore, the first actuator 13 causes the first switch element 15 to perform a switching operation, and the second actuator 23 causes the second switch element 25 to perform a switching operation.

In this manner, for example, as shown in FIG. 3A and FIGS. 4A to 4D, when substantially the center portion of the lower end side of the upper wall 1*c* of the operation body 1 is pressed with a finger or the like, the operation body 1 is inclined downward by the pressing (the inclination direction S), and the two positions on the lower side of the operation body 1, that is, the second and third positions P2 and P3 are lowered. In addition, via the elastic member 7 described later, the second actuator 23 disposed to oppose the second position P2 and the third actuator 33 disposed to oppose the third position P3 are pressed downward, and the second actuator 23 causes the second switch element 25 to perform a switching operation and the third actuator 33 causes the third switch element 35 to perform a switching operation.

Similarly, for example, when substantially the center portion of the right end side of the upper wall 1*c* of the operation body 1 is pressed with a finger or the like, the operation body 1 inclined to the right by the pressing (the inclination direction E), and the third actuator 33 causes the third switch element 35 to perform a switching operation. Similarly, when substantially the center portion of the upper end side of the upper wall 1*c* of the operation body 1 is pressed with a finger or the like, the operation body 1 is inclined upward by the pressing (the inclination direction N), and the first actuator 13 causes the first switch element 15 to perform a switching operation.

Similarly, for example, when the operation body 1 is inclined in the first inclination direction D1, the first actuator 13 causes the first switch element 15 to perform a switching operation. When the operation body 1 is inclined in the second inclination direction D2, the second actuator 23 causes the second switch element 25 to perform a switching operation. When the operation body 1 is inclined in the third inclination direction D3, the third actuator 33 causes the third switch element 35 to perform a switching operation.

Figure 9:
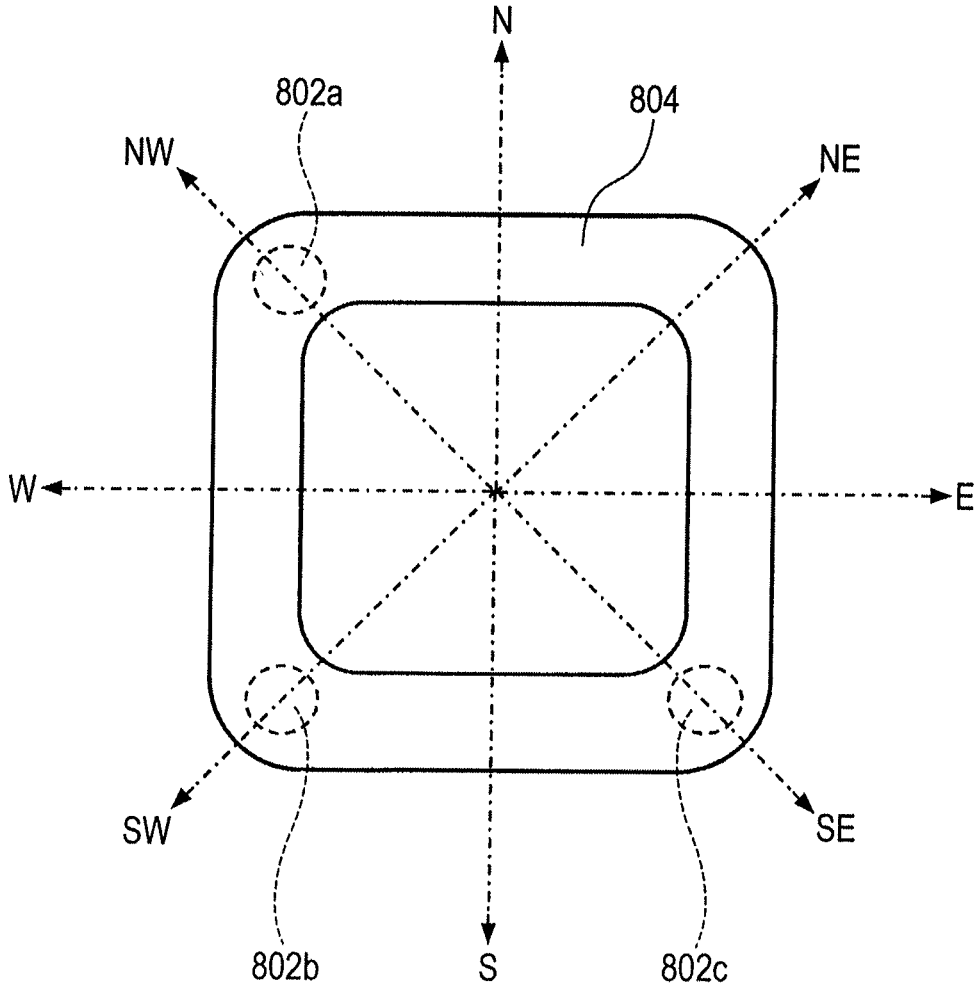
FIG. 9 is a plan view of an operation body showing oscillation directions of an operation member in the switch device of the example 1 according to the related art.

In the configuration as in the example 1 according to the related art, for example, as shown in FIG. 9, when the operation body 1 is inclined in the NE direction (the fourth inclination direction D4 in FIG. 3A), there is a problem in that all the switch elements 806 do not perform switching operations and a non-operation region where a switching operation is not performed is generated.

However, in the multi-directional switch device 101 of the invention, for example, when the operation body 1 is inclined in the fourth inclination direction D4, the fourth actuator 43 disposed between the first and fourth positions P1 and P4 to be closer to the first position P1 side is present, so that the fourth actuator 43 subjected to the inclination operation of the operation body 1 causes the first switch element 15 to perform a switching operation. Even when a directional angle of the fourth inclination direction D4 is slightly changed, the fourth actuator 43 reliably causes the first switch element 15 to perform a switching operation. As such, even when the operation body 1 is inclined in a direction of the non-operation region where a switching operation is not performed, the position of the fourth actuator 43 is disposed in a position at which the first switch element 15 reliably performs a switching operation. Therefore, even though the operation body 1 is inclined in any direction, any of the plurality of switch elements 5 is caused to perform a switching operation.

Accordingly, the multi-directional switch device 101 of the invention is provided with the new fourth actuator 43 in addition to the three actuators 3 (13, 23, and 33) corresponding to the three switch elements 5 (15, 25, and 35), so that the non-operation region where a switching operation is not performed when the operation body 1 is operated to be inclined can be eliminated. Moreover, there is no need to add a switch element, resulting in a reduction in size.

In the multi-directional switch device 101 of the invention, as shown in FIG. 5, a passive component 98 such as a chip capacitor or a chip resistor may be mounted at a point of the printed wiring board 88 opposing the fourth position P4. Therefore, the printed wiring board 88 can be reduced in size, so that it is possible to achieve a reduction in the size of the multi-directional switch.

In addition, in the multi-directional switch device 101, the first, second, third, and fourth positions P1, P2, P3, and P4 are disposed at the vertices of a square in which each side is 20 mm, and the position P14 opposing the fourth actuator 43 is disposed at a point distant from the first position P1 by 7.5 mm on a straight line connecting the first and fourth positions 91 and P4.

The position P14 may deviate from the straight line connecting the first and fourth positions P1 and P4 and may be a position other than a relative position between the first and fourth positions P1 and P4. In addition, a rectangle may be used instead of the square, and for example, a pentagon may also be used. Since the position P14 is determined depending on the positional relationship between the vertices of the rectangle, the lengths of the sizes of the rectangle, the inclination angle (the pressing depth of the inclination) of the operation body 1, and the like, even though the operation body 1 is operated to be inclined in the direction of the non-operation region where a switching operation is not performed, the first switch element 15 is reliably determined to be disposed at a position where a switching operation is performed.

In addition, the multi-directional switch device 101 of the invention connects the first and fourth actuators 13 and 43 with a connection portion 3*r* to be integrated with each other as shown in FIG. 5. Accordingly, by integrating the two actuators 3 (13 and 43) with each other, compared to a case where an additional mechanism is provided for each of the actuators 3 (13 and 43), a greater reduction in size can be achieved, and assembly can be easily performed.

In addition, the multi-directional switch device 101 of the invention is provided with the elastic member 7 between the operation body 1 and the actuator 3. The elastic member 7 is made of, for example, an elastic rubber material, is formed by a forming process, and as shown in FIG. 1, includes an elastic base portion 7*k* which is a substantially rectangular flat plate, four elastic portions 17*a*, 17*b*, 17*c*, and 17*d* which are provided at four angular portions in the peripheral edge of the elastic base portion 7*k* and are substantially dome-like, and an elastic portion 17*e* provided between the elastic portions 17*a* and 17*d*. In addition, the front end portions of the elastic portions 17 (17*a*, 17*b*, 17*c*, 17*d*, and 17*e*) of the elastic member 7 have circular flat portions, and the flat portions abut on the rear surface of the base body 1*a* of the operation body 1 to elastically urge the operation body 1 outward from the housing 2.

The elastic portions 17 are disposed to be the peripheral edges of the operation body 1 in the housing 2, and the elastic portions 17*a*, 17*b*, 17*c*, and 17*e* correspond to the first, second, third, and fourth actuators 13, 23, 33, and 43.

In addition, the elastic portion 17 that abuts on the operation body 1 is buckled by the inclination operation of the operation body 1, the rear surface of the buckled elastic portion 17 abuts on the actuator 3 to press the actuator 3. By the buckling, the operator obtains a clicking sensation. Moreover, since the elastic portion 17*d* which does not correspond to any of the actuators 3 is provided at the fourth position P4, a clicking sensation is reliably obtained even when the operator performs an inclination operation in any direction. Accordingly, as the elastic member 7 having the elastic portions 17 corresponding to the respective actuators 3 is provided between the actuators 3 and the operation body 1, the elastic portion 17 is buckled, and when the operation body 1 is operated to be inclined, the operator can obtain a clicking sensation.

Accordingly, the multi-directional switch device 101 of the invention is provided with the new fourth actuator 43 in addition to the three actuators 3 (13, 23, and 33) corresponding to the three switch elements 5 (15, 25, and 35), so that when the operation body 1 is operated to be inclined, the non-operation region where a switching operation is not performed is eliminated. Moreover, there is no need to add a switch element, resulting in a reduction in size.

In addition, since the first and fourth actuators 13 and 43 are connected to each other by the connection portion 3*r* and thus are integrated with each other, compared to a case where an additional mechanism is provided for each of the actuators 3 (13 and 43), a greater reduction in size can be achieved, and assembly can be easily performed.

As the elastic member 7 having the elastic portions 17 corresponding to the respective actuators 3 is provided between the operation body 1 and the actuator 3, the elastic portion 17 is buckled, and when the operation body 1 is operated to be inclined, the operator can obtain a clicking sensation.

Next, an operation circuit of the multi-directional switch device 101 will be described.

Figure 6:
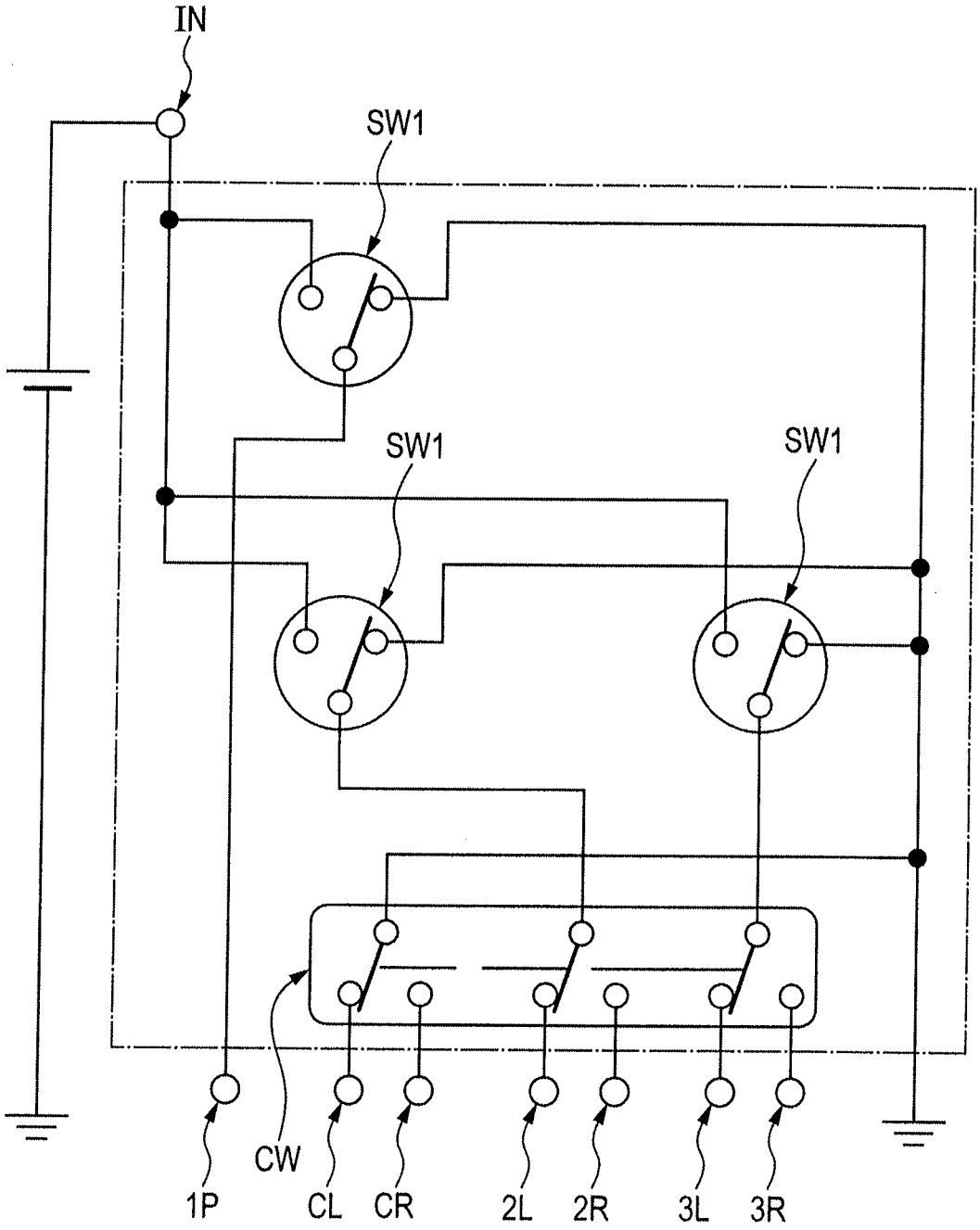
FIG. 6 is a circuit diagram of the multi-directional switch device of a first embodiment of the invention.
Figure 7:
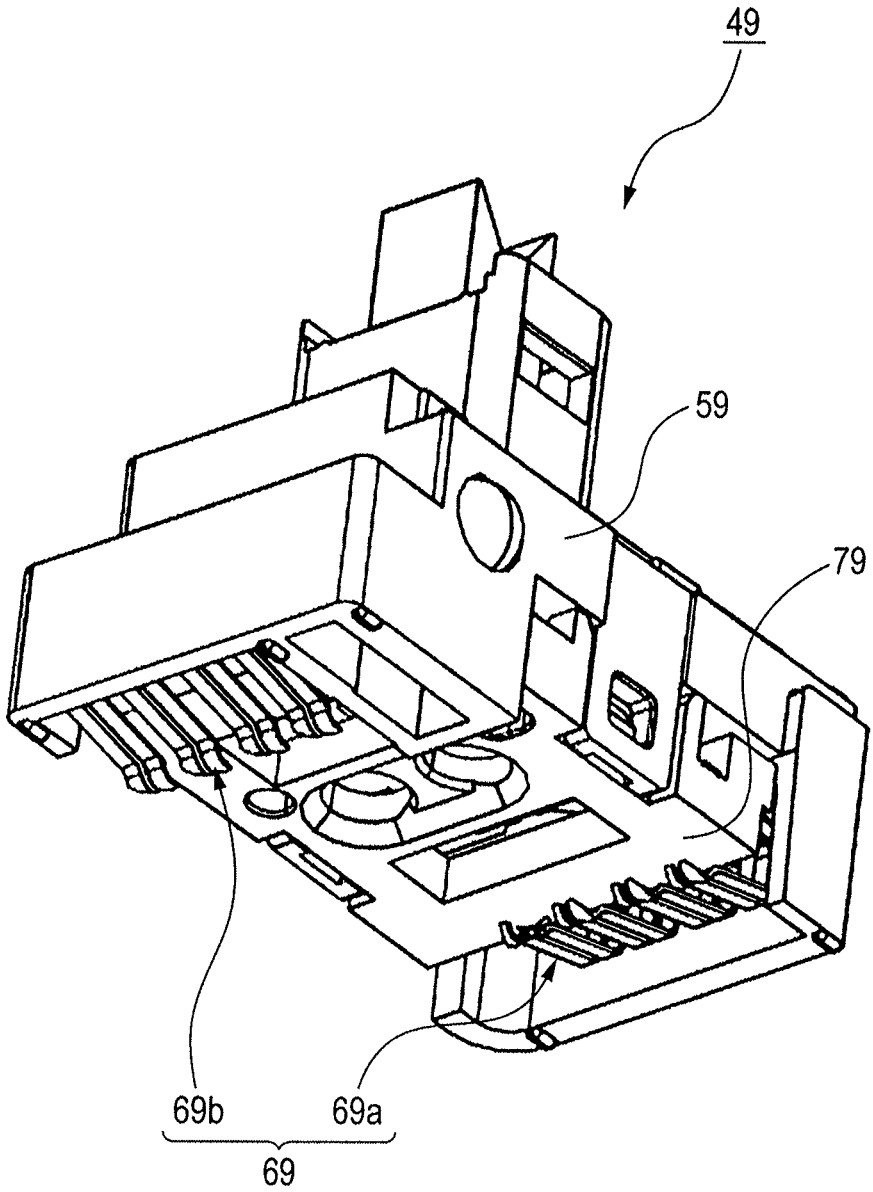
FIG. 7 is a diagram illustrating a changeover switch of the multi-directional switch device of the first embodiment of the invention and is a perspective view of a changeover contact point member viewed from a changeover movable contact point side.
Figure 10:
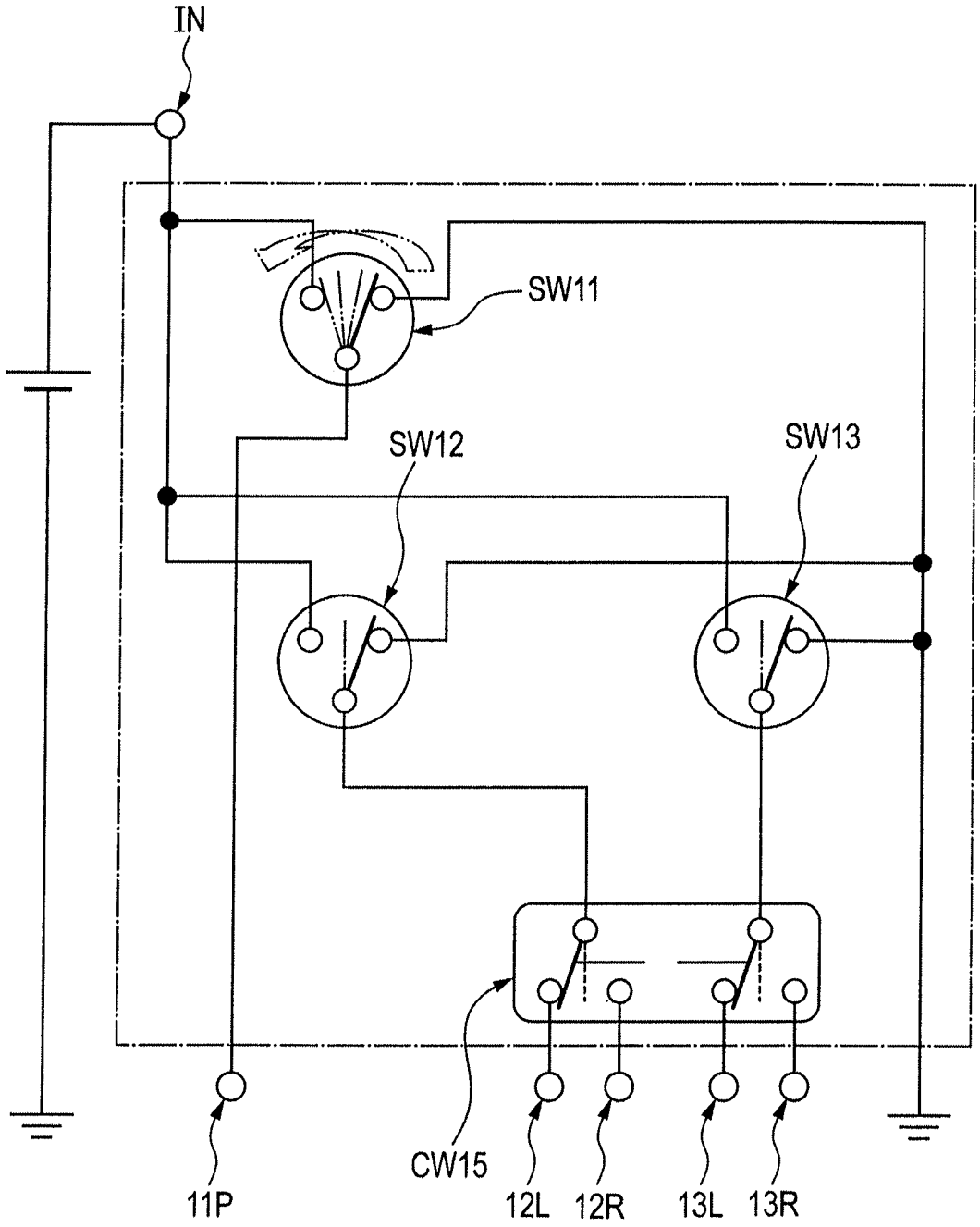
FIG. 10 is a circuit diagram of the switch device of the example 1 according to the related art.
Figure 11A:
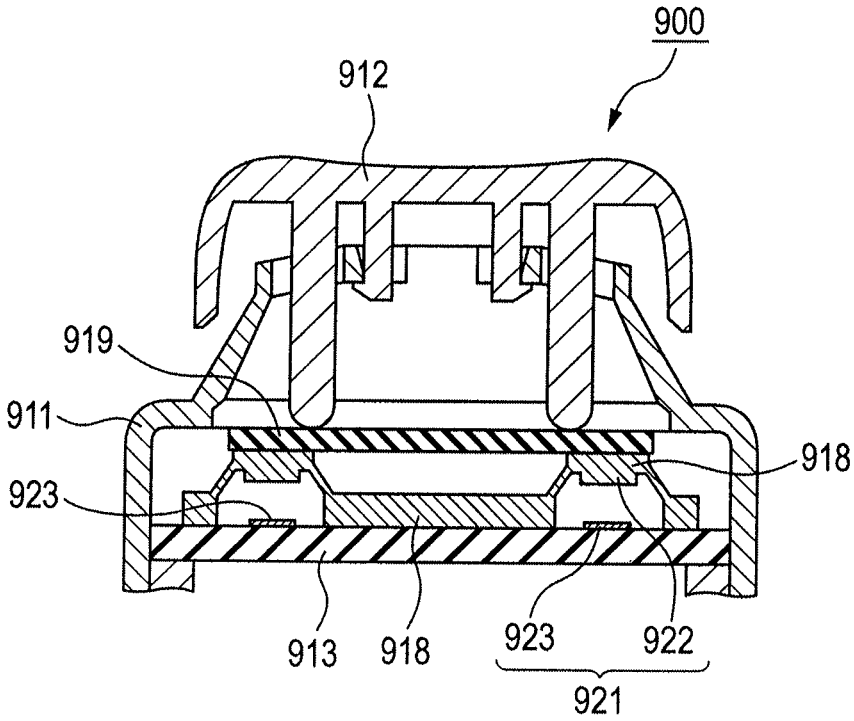
Figure 11B:
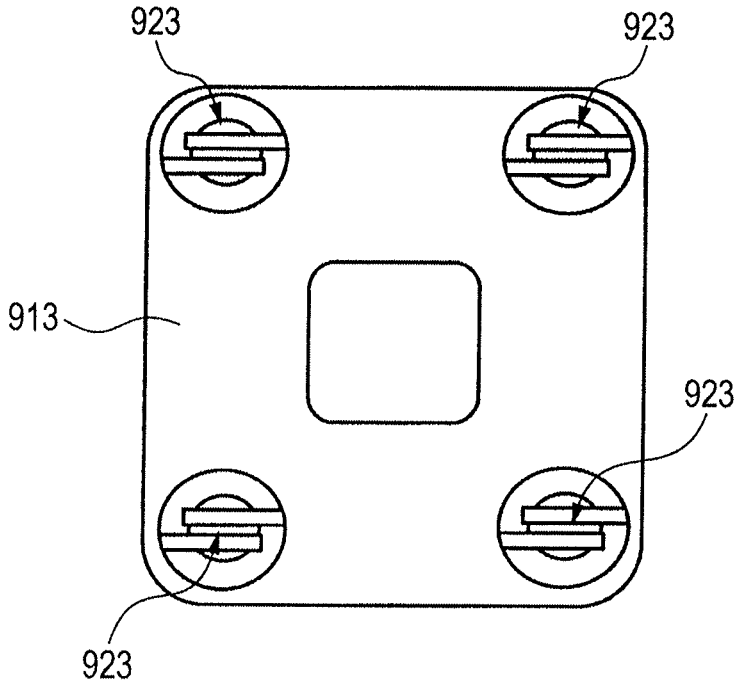

FIG. 6 is a circuit diagram of the multi-directional switch device 101 of a first embodiment of the invention. FIG. 7 is a diagram illustrating the changeover switch 99 of the multi-directional switch device 101 of the first embodiment of the invention and is a perspective view of a changeover contact point member 49 viewed from a changeover movable contact point 69 side. FIG. 10 is a circuit diagram of a switch device 800 of the example 1 according to the related art. In addition, since the multi-directional switch device 101 and the switch device 800 of the example 1 according to the related art have a changeover switch for changing over an object to be subjected to a switching operation and a switch for changeover (not shown in FIG. 8), changeover switch circuits are given at the same time in FIGS. 6 and 10.

The changeover switch 99 shown in FIGS. 1 and 7 mainly includes a changeover operation member 19 which performs a slide operation, a changeover housing 29 which holds the changeover operation member 19, a changeover driving member 39 which performs a slide movement in response to the slide movement of the changeover operation member 19, a changeover contact point member 49 having a changeover movable contact point 69 for performing a switching operation by a slide movement in response to the movement of the changeover driving member 39, and a changeover fixed contact point 89 which performs a switching operation by coming into contact with or being separated from the changeover contact point member 49.

In addition, the changeover contact point member 49 includes a contact point base material 79 which holds the changeover movable contact point 69 and a changeover case 59 which is fitted to the contact point base material 79. In addition, the changeover fixed contact point 89 is formed on the printed wiring board 88, and is produced in the same process on the same surface as the fixed contact point 8. In addition, the changeover housing 29 is formed integrally with the housing 2. In addition, in addition to a changeover movable contact point (although not shown in FIG. 8, corresponding to the changeover movable contact point 69*a*) and a changeover fixed contact point corresponding to the changeover movable contact point (although not shown in FIG. 8, corresponding to the changeover fixed contact point 89*a*) which are also present in the example 1 according to the related art, a changeover movable contact point 69*b* and a changeover fixed contact point 89*b* corresponding to the changeover movable contact point 69*b* are newly provided.

The changeover switch 99 for changing over an object to be subjected to a switching operation is applied to, for example, an operation of door mirrors of a vehicle and is used to change over the operations of a left (L) door mirror and a right (R) door mirror.

In the circuit diagram of the switch device 800 of the example 1 according to the related art shown in FIG. 10, three switches SW11, SW12, and SW13 corresponding to the three switch elements 806, and a switch CW15 corresponding to the switch for changeover for changing over the left side (L) and the right side (R) are shown. The three switches SW1, SW2, and SW3 are in OFF positions, and the switch CW11 is changed over to the operation side of the left (L) door mirror.

Figure 8:
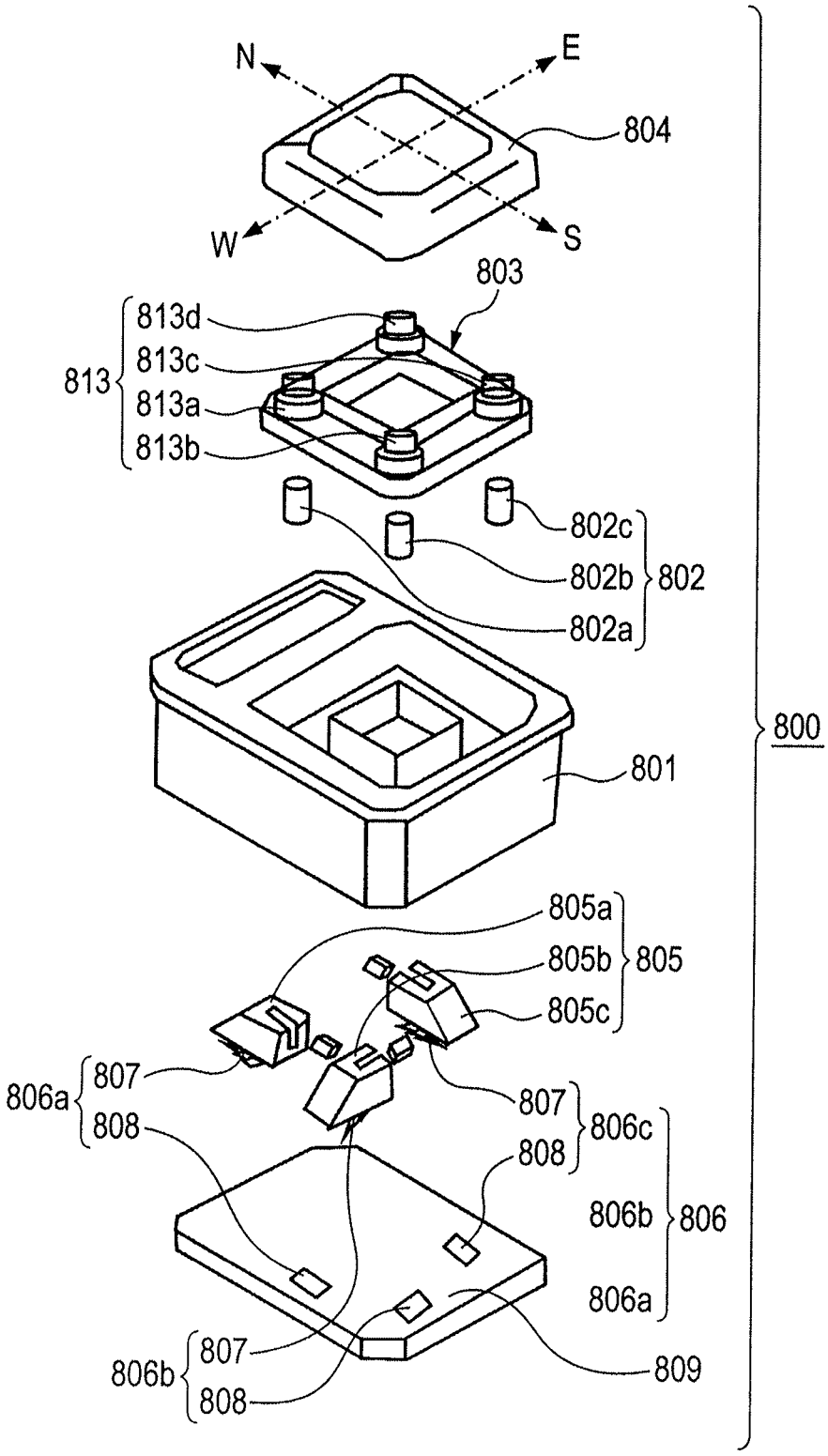
FIG. 8 is an exploded perspective view illustrating a switch device of an example 1 according to the related art.

In the switch device 800 of the example 1 according to the related art, when the operation member 804 is oscillated, for example, in the N direction shown in FIG. 8 and the switching element 806*a* performs a switching operation, the switch SW11 is switched from the OFF position to the ON position like the movement of the dot-dot-dashed line of the SW11 shown in FIG. 10, and an output signal is output to a mirror unit from an output terminal 11P. The mirror unit receives the output signal and drives the motor of mirror to move upward the left (L) door mirror. Similarly, the operation member 804 is oscillated in the W direction and the switches SW11 and SW12 are at the ON position to move the left (L) door mirror to the right. Similarly, the switches SW12 and SW13 which are oscillated in the S direction are at the ON position to move downward the left (L) door mirror, and the switch SW13 oscillated in the E direction is at the ON position to move the left (L) door mirror to the right.

However, when the switch SW12 or the switch SW13 is switched from the OFF position to the ON position, there may be a phenomenon in which output signals from output terminals 12L, 12R, 13L, and 13R are cut, and the mirror unit miscalculates that the switch for changeover is at the OFF position as shown by the dot-dot-dashed line of the CW15 corresponding to the switch for changeover shown in FIG. 10 and returns the mirror position to the standard position.

Here, in the multi-directional switch device 101 of the first embodiment of the invention, as shown in FIG. 6, a switch for position detection is added to the switch CW corresponding to the changeover switch 99 for changing over an objected to be subjected to a switching operation. Other configurations are the same as those of the switch device 800 of the example 1 according to the related art, and the three switches SW1, SW2, and SW3 corresponding to the three switch elements 5, and the switch CW are shown.

The switch for position detection switches between the left side (L) and the right side (R) using the changeover movable contact point 69*b* and the changeover fixed contact point 89*b* provided in the changeover switch 99 to be output from terminals CL and CR for detection shown in FIG. 6 to the mirror unit. In addition, a common terminal of the switch for position detection is connected to the ground.

Since the switch for position detection is provided, when changed over to the left side (L) or the right side (R), a signal is always output from the terminal CL for detection and the terminal CR for detection. Therefore, by identifying the output signal, even when the output signals from the output terminals 2L, 2R, 3L, and 3R of the switch SW2 or the switch SW3 are cut, the mirror unit does not miscalculate that the changeover switch 99 is at the OFF position. Accordingly, the multi-directional switch device 101 with high reliability can be provided.

In addition, the switch for position detection can be configured only by newly providing the changeover movable contact point 69*b* and the changeover fixed contact point 89*b* in the changeover switch 99 and thus can be achieved by simple design change and with minimal addition of members and processes. Accordingly, the multi-directional switch device 101 with high reliability can be provided at low cost.

In addition, the invention is not limited to the embodiment, and for example, the following modifications can be made and such embodiments belong to the scope of the invention.

In the embodiment, the changeover switch 99 is integrated but may also be configured into separate members.

In the embodiment, the changeover switch 99 is provided in the configuration, but the changeover switch 99 may also not be provided.

In the embodiment, the first and fourth actuators 13 and 43 are configured to be integrated with each other, but may also be configured as separate members so that each of the actuators causes the first switch element 15 to perform a switching operation.

In the embodiment, the elastic member 7 is provided between the operation body 1 and the actuator 3 and the actuator 3 is pressed via the elastic member 7 in the configuration. However, the elastic member 7 may not be provided and the actuator 3 may be pressed by the operation body 1 in the configuration.

The invention is not limited to the embodiments and can be appropriately modified without departing from the spirit and scope of the invention.

It should be understood by those skilled in the art that various modifications, combinations, sub-combinations and alterations may occur depending on design requirements and other factors insofar as they are within the scope of the appended claims of the equivalents thereof.

What is claimed is:

1. A multi-directional switch device comprising:

an operation body, which moves to be inclined in multiple directions;

a housing, which holds the operation body;

a plurality of actuators, which are operated to be pressed by an inclination operation of the operation body so as to be moved; and a plurality of switch elements, which perform switching operations by the movements of the actuators, wherein the plurality of actuators includes a first actuator, a second actuator, a third actuator, and a fourth actuator, the plurality of switch elements includes a first switch element, a second switch element, and a third switch element, in a plan view of the operation body, a first inclination direction passing through the vicinity of an inclination center of the operation body, a second inclination direction intersecting the first inclination direction through the vicinity of the inclination center, a third inclination direction which is the opposite direction to the first inclination direction, and a fourth inclination direction which is the opposite direction to the second inclination direction are provided, in the operation body, a first position in the first inclination direction, a second position in the second inclination direction, a third position in the third inclination direction, and a fourth position in the fourth inclination direction are provided, the first actuator is disposed to oppose the first position and causes the first switching element to perform the switching operation as the operation body is inclined in the first inclination direction, the second actuator is disposed to oppose the second position and causes the second switching element to perform the switching operation as the operation body is inclined in the second inclination direction, and the third actuator is disposed to oppose the third position and causes the third switching element to perform the switching operation as the operation body is inclined in the third inclination direction, and the fourth actuator causes the first switching element to perform the switching operation as the operation body is inclined in the fourth inclination direction, such that the plurality of actuators are disposed at the positions where any of the plurality of switch elements performs the switching operation even though the operation body is operated to be inclined in any direction.

2. The multi-directional switch device according to claim 1, wherein the first actuator and the fourth actuator are integrated with each other.

3. The multi-directional switch device according to claim 1, comprising:

elastic portions corresponding to the respective actuators on the peripheral edges of the operation body in the housing; and an elastic member having the elastic portions, wherein the elastic portion is buckled by the inclination operation of the operation body, such that the elastic portion presses the actuator.

* * * * *